United States Patent [19]

Hart

[11] 4,161,988

[45] Jul. 24, 1979

[54] PORTABLE EARTH CORE SAMPLING MACHINE

[76] Inventor: Ronald D. Hart, 1695 One Washington Plz., Tacoma, Wash. 98402

[21] Appl. No.: 857,391

[22] Filed: Dec. 5, 1977

[51] Int. Cl.[2] ..... E21C 9/00

[52] U.S. Cl. ..... 173/32; 173/152

[58] Field of Search ..... 173/32, 33, 34, 35, 173/36, 37, 39, 45, 27, 152, 153, 154, 155

[56] References Cited

U.S. PATENT DOCUMENTS

| | | | |
|---|---|---|---|
| 2,614,803 | 10/1952 | Wiggins | 173/31 |
| 3,561,545 | 2/1971 | Rassieur | 173/166 |
| 3,741,318 | 6/1973 | Klein et al. | 173/152 |
| 3,780,816 | 12/1973 | Arrington et al. | 173/39 |
| 3,797,587 | 3/1974 | Klein | 173/152 |

*Primary Examiner*—Robert A. Hafer
*Attorney, Agent, or Firm*—Roy E. Mattern, Jr.

[57] ABSTRACT

A portable earth core sampling machine has a principal supporting structure which is an upstanding hydraulic cylinder sub-assembly, comprising, a hydraulic cylinder serving as the principal vertical stationary body, a piston rod serving as the principal vertical extendable body, an elongated guide member secured to the exterior of the hydraulic cylinder, a sleeve slidable up and down the hydraulic cylinder along the elongated guide member, force transmitting tie rods secured between the extendable end of the piston rod and the sleeve, and a base, removably secured to the bottom of the hydraulic cylinder with radially extending legs terminating in receiving portions each holding a removable earth penetrating stake, and equipped to receive other subassemblies to complete the overall portable earth core sampling machine, such as: a hydraulic driving power unit subassembly mounted on the sleeve comprising, a driving hydraulic motor to rotate a hollow core digging auger; a transverse header box having a sheave mounted at each of its ends and mounted on the extendable end of the piston rod; a capstan secured to the hydraulic motor to receive and to power a rope passing over the sheaves of the transverse header box; a hydraulic control subassembly to direct hydraulic liquid to the reversible hydraulic motor and to direct hydraulic liquid to the hydraulic cylinder to move the piston and to control the speed of all hydraulic motions; and a combined hydraulic power source and distribution subassembly often remotely located.

10 Claims, 4 Drawing Figures

PORTABLE EARTH CORE SAMPLING MACHINE

BACKGROUND OF THE INVENTION

Figure 3:
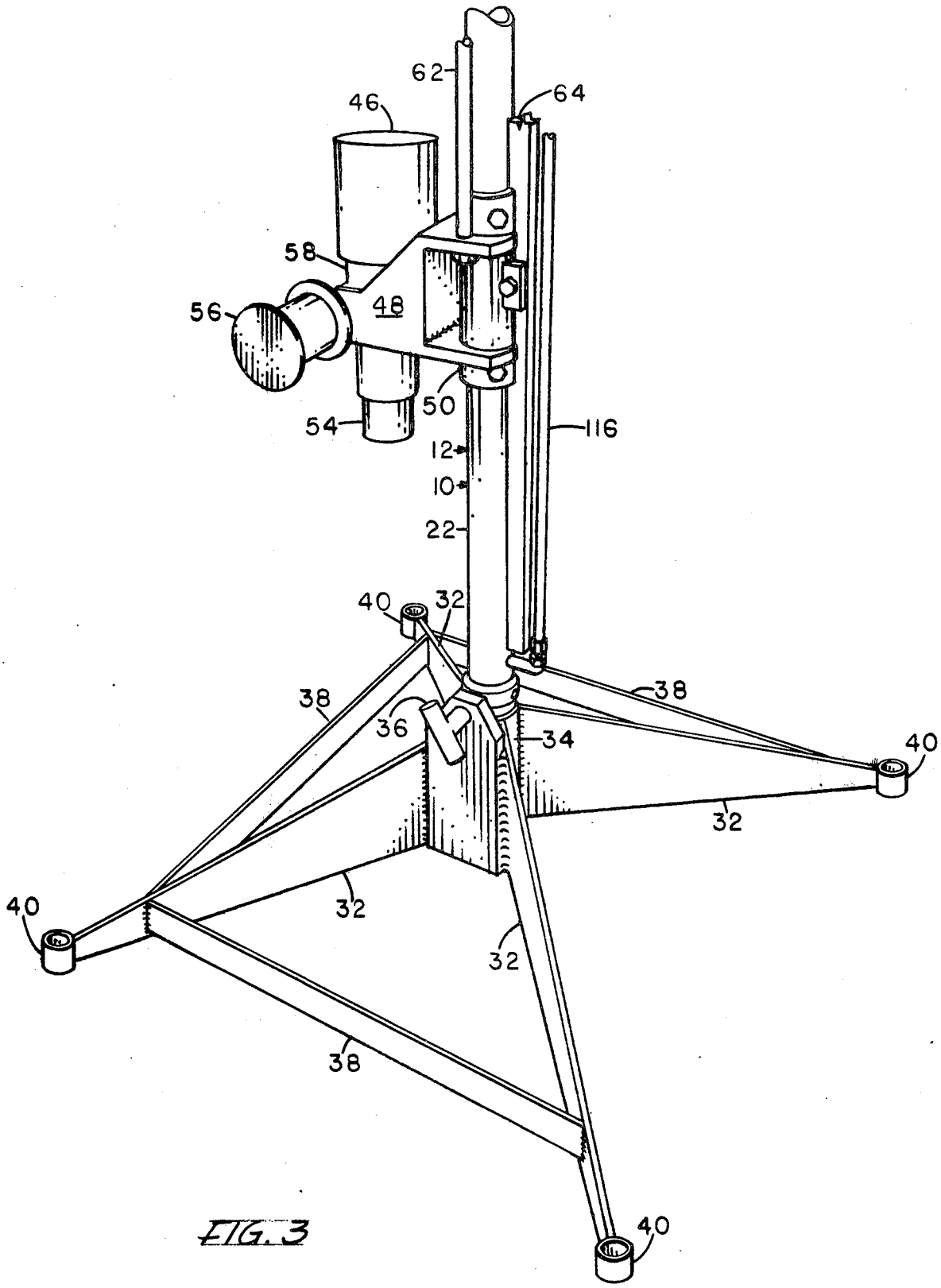

As shown in FIG. 3 of U.S. Pat. No. 2,403,002, most drilling machines are comparatively large and generally mounted on large vehicles. Yet often there are requirements to obtain earth core samples during earth and soil testing operations in places where the larger vehicle mounted drilling machines may not be conveniently used. In these difficult places and in all places, including underwater locations, this principal supporting structure, when equipped in various embodiments creates a portable machine which is conveniently used to obtain earth core samples wherever the earth and soil testing is to be undertaken.

The extreme portability centers on the use of a hydraulic or pneumatic cylinder as the main structural component of the principal supporting structure, and also centers on keeping in a separate power pack many of the hydraulic or pneumatic components, which then may be remotely located from the core drilling locations. For example, the power pack may be kept above the water's surface, while the principal supporting structure, centering on either the hydraulic or pneumatic cylinder, is conveniently manipulated at the underwater site, where the earth core samples are being taken. The initial power pack energy source is gasoline or diesel oil for engines, or electricity for electrical motors.

SUMMARY OF THE INVENTION

During earth and soil testing, earth core samples are readily undertaken in all locations and especially in otherwise inaccessible locations, such as underwater locations, under structure with limited overhead clearance, on steep grades, in remote areas, ect. where larger equipment, often mounted on vehicles, is not usuable. The samples are taken by using a principal supporting structure, which is portable and centers on the use of either a hydraulic or pneumatic cylinder as the principal upstanding structure, of a portable machine. Also many of the hydraulic or pneumatic components are kept in a power pack which is often remotely located from the principal supporting structure, especially in underwater operations where the power pack remains above the water.

In one embodiment the principal supporting structure is essentially the hydraulic cylinder, a piston rod extendable beyond the hydraulic cylinder to a distance almost equal to its length, force transmitting tie rods secured to piston rod end and extended back to the hydraulic cylinder and passing through guides secured to the cylinder, an elongated guide member secured to the cylinder exterior, and a sleeve slidable up and down the hydraulic cylinder having a follower to slide along the elongated guide, when the sleeve is secured to the force transmitting tie rods as they move with the piston. To this principal supporting structure a removable base is added, when necessary, having radial extending legs terminating in receiving portions equipped with earth penetrating stakes drivable through the receiving portions.

On this slidable sleeve a hydraulic driving power unit subsassembly is mounted, comprising a driving hydraulic motor and its attachment accessories to secure and to rotate a hollow core digging auger, and to secure and to rotate a capstan. The capstan receives and powers a rope passing over the sheaves of a transverse header box, which is mounted on the end of the piston rod. The rope at one end is secured to a calibrated hammer used in preparing a core sample and at its other end, after passing around the capstan at least once, is guided by an operator. The operator by adjusting the height of the piston rod equipped with the transverse header box and operating the capstan conveniently handles this calibrated hammer and other equipment during its positioning over the location where the earth core samples are being taken.

Preferably, a hydraulic control subassembly is secured to the elongated guide member of the hydraulic cylinder in a position clear of the travel of the sleeve and at a height conveniently manipulated by an operator. It includes multiple valves to direct hydraulic liquid to the hydraulic cylinder to extend or to retract the piston and correspondingly move the transverse header, the tie rods, and the sleeve.

To unburden the operator at the immediate location of taking the earth core samples, and especially in reference to underwater operations, the hydraulic power source and distribution subassembly is arranged for remote operation. A hydraulic pump, a motor to drive the hydraulic pump and a hydraulic tank, are secured together in a conveniently handled power pack for remote placement. Then a selected subassembly of hoses and fittings are used to conduct the hydraulic liquid to and from the often remotely located power pack, during the distribution of the hydraulic liquid via the hydraulic control subassembly to the hydraulic cylinder subassembly and to the hydraulic driving power unit subassembly. By using this principal supporting structure and the resulting portable machine, either hydraulic or pneumatic, earth core samples are taken during soil testing operations, often occurring many times in what before seemed to be inaccessible locations for carrying on convenient and efficient earth and soil testing operations. The initial power pack energy source is gasoline or diesel oil for engines, or electricity for electrical motors.

DRAWINGS OF THE PREFERRED EMBODIMENT

Figure 1:
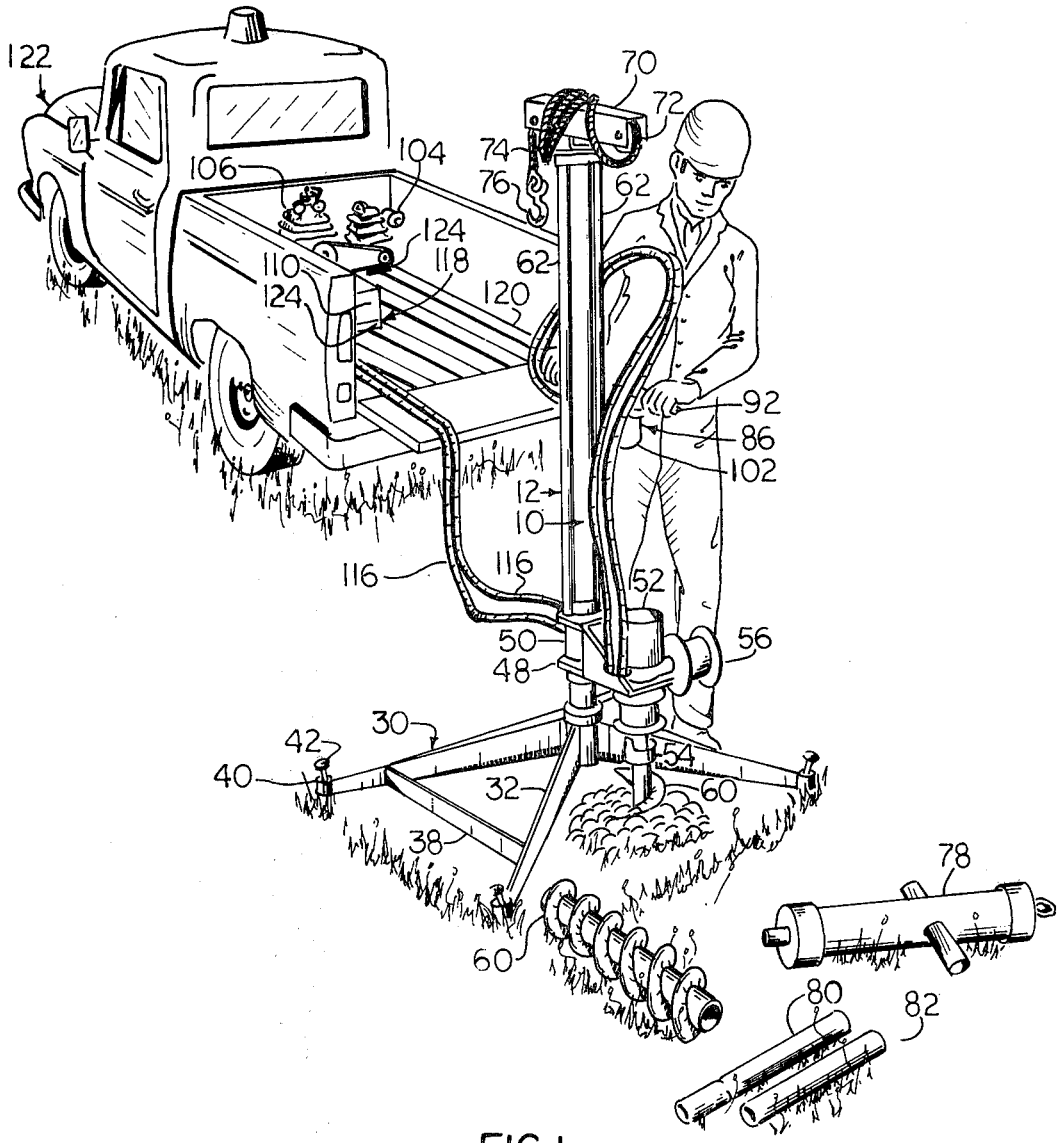
Figure 2:
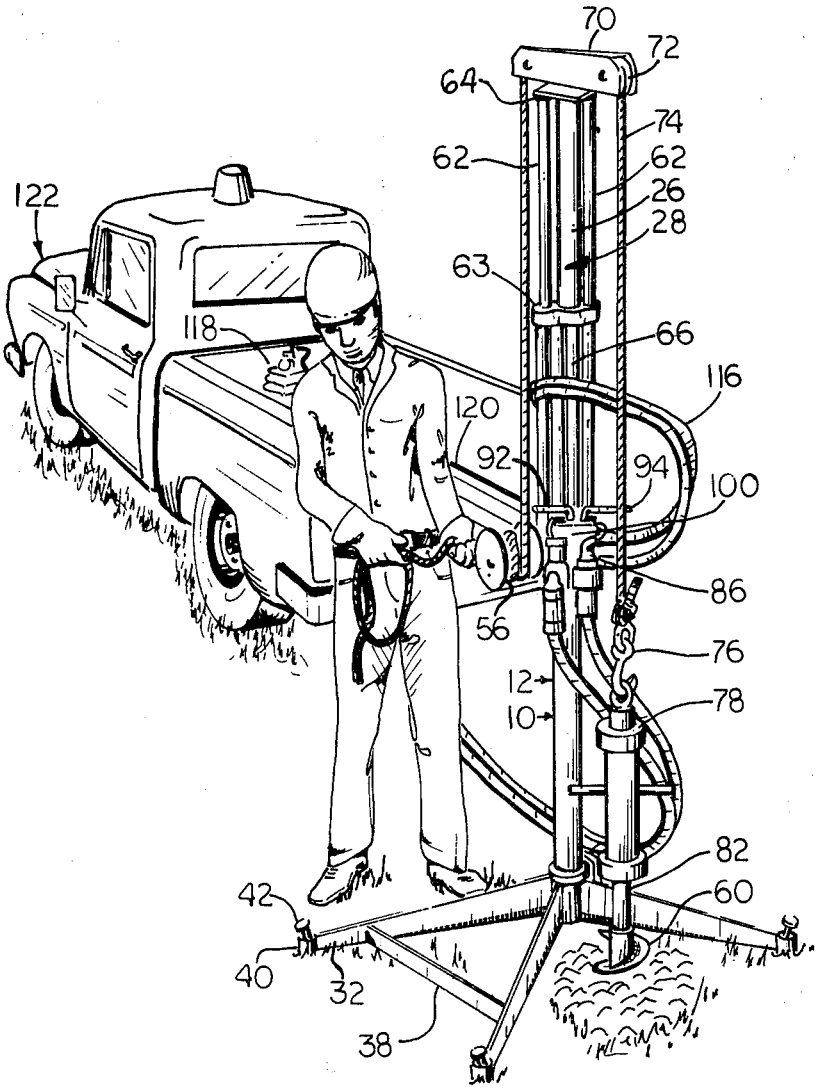
Figure 4:
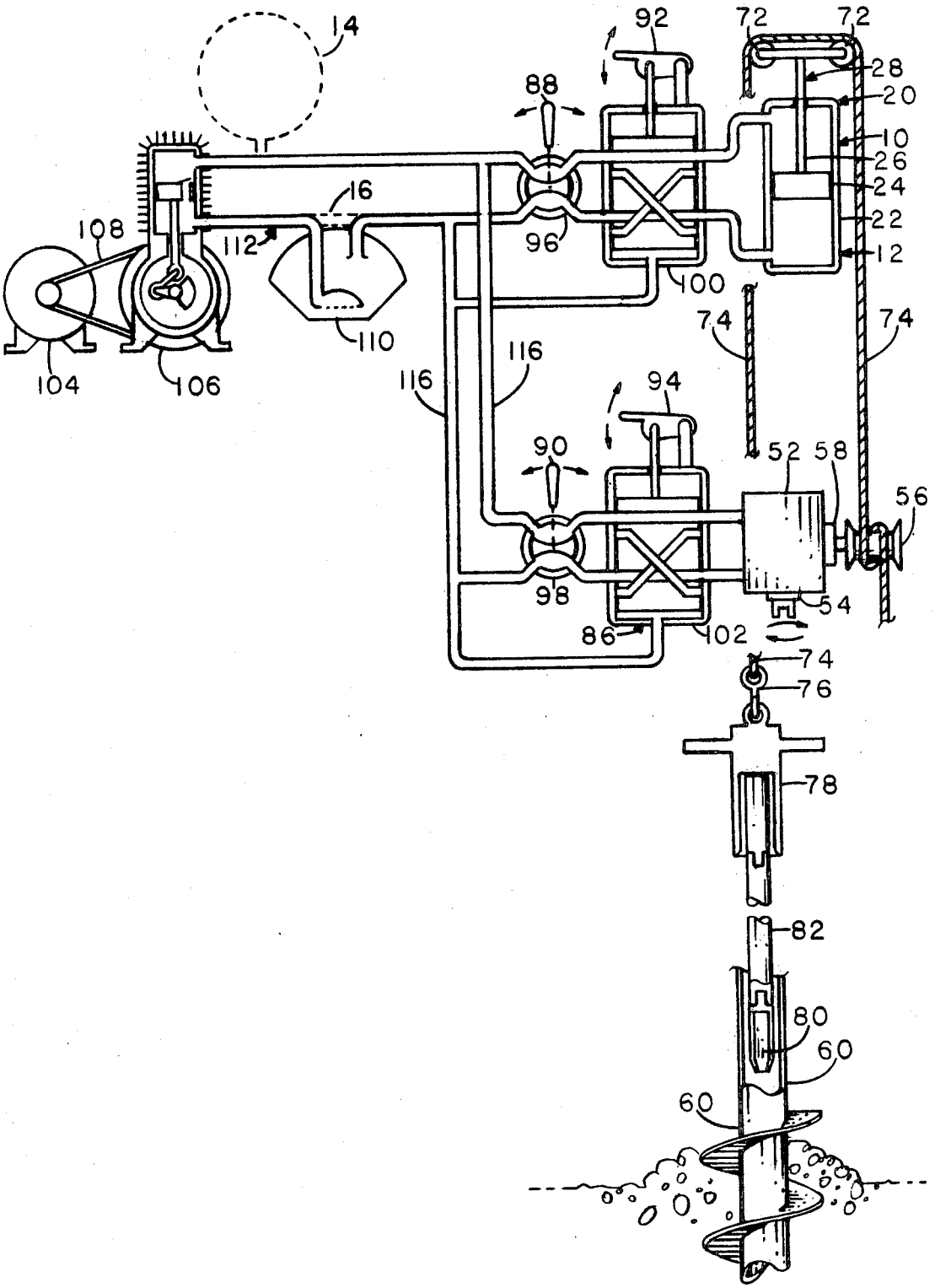

FIG. 1 is a perspective view of an operator standing alongside the principal supporting structure, i.e. the hydraulic cylinder of a preferred embodiment, utilizing the various hydraulic subassemblies of the overall portable machine, as the hollow core auger is digging, and indicating the remote location of the power pack, and the nearby location of other tools yet to be used, i.e. another hollow core auger section, a core rod, and a core hammer;

FIG. 2 is a perspective view, similar to FIG. 1, however, the operator has extended the piston from the hydraulic cylinder, that is serving as the principal supporting structure, to position the transverse header box and its sheaves and the rope system, being powered via the hydraulic driving motor and capstan, to conveniently lift and manipulate the calibrated core hammer to prepare the earth core sample during earth and soil testing operations;

FIG. 3 is a partial perspective view, with portions removed for illustrative purposes, of the hydraulic driving power unit subassembly showing its guided slidable sleeve mounting on the principal supporting structure, i.e. the hydraulic cylinder, and its drive both of the hollow core auger and the capstan; and FIG. 4 is a schematic diagram of the entire hydraulic system showing the power pack and its components, the hydraulic lines, valves of the hydraulic control subassmbly, the hydraulic driving power unit subassembly, and the hydraulic cylinder and piston subassembly, and also illustrating the utilization of the transverse header box, its sheaves and rope, in handling the equipment used in drilling and taking earth core samples, and to indicate how a pneumatic system is used, dotted lines represent the location of an air pressure tank.

DESCRIPTION OF THE INVENTION

In FIGS. 1 through 4, a preferred embodiment is illustrated of a principal supporting structure 10 for a portable machine 12, used, when fully equipped, in taking earth core samples during earth or soil testing operations. FIG. 4 schematically indicates how both hydraulic and pneumatic fluid systems are utilized, dotted lines indicating a location of a compressed air tank 14, and a fluid line change 16, and the solid lines indicating the hydraulic oil system.

Principal Upstanding Supporting Structure and its Ground Support

As illustrated in FIGS. 1, 2 and 3, the principal upstanding supporting structure 10 of the earth core sample taking portable machine 12 is essentially a fluid cylinder-piston subassembly 20, either hydraulic or pneumatic, comprising a fluid cylinder 22, serving as the principal upstanding stationary body 22, of this portable machine 12; and a piston 24 with its piston rod 26, serving as the principal upstanding extendable body 28 of this portable machine 12. During most earth drilling and earth core sampling operations, this principal upstanding supporting structure 10 is supplemented by a removable base subassembly 30, serving as its ground support. It has four spaced radially extending legs 32 extending outwardly from a center receiver 34, which fits around the fluid cylinder 22, and is secured thereto by an insertable pin fastener 36, in a choice of two positions, 180 degrees apart. The radially extending legs 32, at three locations, are held together by braces 38. Also these legs 32 terminate in vertical cylindrical receivers 40, through which earth penetrating stakes 42 are driven, to transfer the reactive torque forces to the earth during drilling operations.

Fluid Driving Power Unit Subassembly and its Mounting

As illustrated in FIGS. 1 and 3, a fluid driving power unit subassembly 46 has a frame 48 secured to partial sleeve 50, which slides up and down the exterior of the principal stationary body 22, i.e. the fluid cylinder 22. A fluid motor 52 and its coupling 54 is mounted on frame 48. Also a capstan 56 and right angle drive unit 58 are mounted on the frame 48. The earth core sampling drilling auger sections 60 are alternately secured to the coupling 54 of the fluid motor 52 and to each other as the drilling operations are undertaken.

Force Transmitting Rods Attached Between Partial Sleeve Slidable on the Fluid Cylinder and the Upward Extendable End of the Piston Rod As illustrated in FIGS. 1, 2 and 3, the partial sleeve 50, to which the frame 48 is attached, is also secured to two force transmitting rods 62 at their bottom. They, 62, in turn are secured at their tops to a transverse plate 64 secured to the upward extendable end of the piston rod 26. Also these force transmitting rods 62 slide through a guide 63 secured to the top of the fluid cylinder. The extending and retracting movements of the piston rod 26 and its piston 24, i.e. the extendable body 28, therefore are also the upwardly and downwardly sliding movements of the partial sleeve 50 along the exterior of the fluid cylinder 22, and therefore along the exterior of the principal supporting structure 10. The partial sleeve 50 is guided and kept from turning relative to the fluid cylinder 22, by the elongated guide member 66 which is secured to the fluid cylinder 22. As necessary, an end thrust is generated by the fluid cylinder-piston subassembly 20, through these force transmitting rods 62, during drilling operations. At other times the fluid driving power unit subassembly 46 is positioned at other convenient locations along the fluid cylinder 22 by using the fluid cylinder-piston subassembly 20 and these force transmitting rods 62.

A Transverse Header Box Having Sheaves Mounted at Each End and In Turn Mounted on the Transverse Plate Secured on the Upward Extendable End of the Piston Rod to Receive a Rope Utilized with the Capstan and Sheaves to Handle a Calibrated Core Sampling Hammer, etc.

As illustrated in FIGS. 1 and 2, at the top of this portable machine 12, there is a transverse header box 70 secured to the transverse plate 64 fastened in turn to the extendable end of the piston rod 26. At each of its ends sheaves 72 are rotatably mounted. A rope 74 is guided over the sheaves 72 and down one side of the principal supporting structure 10, to be wrapped around the capstan 56 and beyond for hand control by an operator, as shown in FIG. 2. The other end of the rope 74 is tied to a lifting hook 76. It in turn is used to attach various core drilling accessories, such as the core sampling rod components 80, 82.

Fluid Control Subassembly to Control Amount of Fluid Flowing and Where the Fluid Flows to Either or to Both the Fluid Motor and Fluid Cylinder-Piston Subassembly As illustrated in FIGS. 1 and 4, there is a preferred embodiment of a fluid control subassembly 86 mounted at a convenient height, about waist high, on the principal supporting structure 10 of this portable earth core sampling machine 12. By moving respective valve handles 88, 90, 92, 94, respective flow regulation and shut off valves 96, 98, and flow direction valves 100, 102, are actuated to gain the fluid operational forces desired during the various operations. Optionally only one flow regulation valve at another location is used. Also optionally the fluid flow shut off is undertaken at another location.

Referring to the schematic view of FIG. 4, a principal power source 104, which is either an electric motor, or gasoline or diesel engine is used to drive a pump 106 or an air compressor 106, via a drive belt 108. When a hydraulic oil system is used, then a reservoir 110 is included in the fluid line system 112. When a pneumatic system is usd, then a compressed air tank 114 is included in the fluid line system 112, the lines 116 and valves etc. being sized and designed accordingly to meet the different fluid requirements.

The raising and lowering of extendable body 28, i.e. the piston-piston rod combination 28, is undertaken, when valve 96 is opened and set at a selected flow rate upon movement of valve handle 88, and also valve handle 92 is moved to set flow directional valve 100 to direct the fluid, either to raise or to lower this extendable body 28, the lowering being illustrated in FIG. 4.

The rotation in either direction of the capstan 56, is undertaken, when valve 98 is opened and set at a selected flow rate upon movement of valve handle 90, and also valve handle 94 is moved to set flow directional valve 102 to direct the fluid, either to rotate the capstan 56 in one rotative direction or the other rotative direction, i.e. clockwise or counterclockwise, the counterclockwise rotation being illustrated in FIG. 4. The rotative movement of the capstan 56 is utilized to create a lifting force, via the rope 74, as it is wrapped around the capstan and guided over the sheaves 72, to its lifting hook 76, secured, for example, to the core sampling hammer 78, as illustrated in FIGS. 2 and 4.

Remote Location Arrangement of Selected Components of the Fluid Power and Control System As illustrated in FIGS. 1 and 2, serveral of the components illustrated in FIG. 4 are arranged in a power pack 118 for remote positioning, operation, and handling, being kept for example, on the bed 120 of a pickup truck 122. For example, the power source 104, such as a gasoline engine 104, the hydraulic oil pump 106, and the hydraulic oil reservoir 110 with some of the fluid lines 116, are arranged as a power pack 118, on a conveniently handled supporting platform 124.

Summary of Principal Advantages

The utilization, in this portable earth core sampling machine 12, of a principal supporting structure 10, comprising essentially a principal upstanding stationary body 22, which is a hydraulic cylinder 22, and an upstanding extendable body 28, which is a piston-piston rod combination, substantially reduces the overall weight of the core sampling machine 12, or drilling rig 12. To further enhance the portability and handling of this drilling rig 12, the power pack 118 is arranged for remote placement, handling, storage, transport, and positioning, thereby giving an operator hand and arm positioning, transport, and control, capabilities, related only to the principal supporting structure 10 and its various accessories used at an intermediate drilling and earth core sampling location.

Particularly, this overall arrangement makes it possible to carry the principal supporting structure 10 into locations not otherwise accessible to other earth core sampling machines, such as bog areas or low clearances areas. Moreover, it is possible to take the principal supporting structure 10 and its immediate accessories below the surface of water to successfully carry out earth core sampling under water. All these operations, above and below water, are undertaken very conveniently in these new areas and in all areas, using conventional methods in taking earth core samples.

Although, the portability, of the illustrated earth core sampling machine 12, centering on its principal supporting structure 10, is outstanding, it is also to be considered and realized that the machine 12 in other embodiments, not illustrated is larger. The principal upstanding stationary body 22, i.e. fluid cylinder 22, in other embodiments is much larger and is a functional derrick. It is mounted on a vehicle or erected at a job site. Moreover, being available in many sizes, the principal supporting structure 10, equipped with suitable specified drilling accessories, is used for drilling through soil and rock, gaining all of the advantages of utilizing a fluid cylinder 22, as the principal upstanding stationary body 22.

I claim:

1. A portable machine for drilling into the earth and taking earth core samples during soil testing operations, comprising:

(a) a fluid cylinder subassembly comprising in turn: a fluid cylinder, serving also as the principal stationary body portion of this portable machine, a piston rod, serving also as the principal extendable body portion of this portable machine; an elongated guide member firmly secured to the outside of the fluid cylinder, between fluid ports located at both the top and bottom of the fluid cylinder; a transverse header box having a sheave mounted at each of its ends and in turn mounted on the extending end of the piston rod; and a base secured to the fluid cylinder to position the fluid cylinder subassembly on the earth while taking earth core samples;

(b) a traveling support subassembly for a fluid power unit subassembly comprising, in turn, a partial sleeve to be guided up and down the outside of the fluid cylinder and kept from turning by the elongated guide member; power transmitting tie rods secured between partial sleeve and the transverse header box, whereby the traveling support subassembly moves along the exterior of the fluid cylinder in direct relation to the movement of the piston rod in and out of the cylinder; and a guide for the tie rods secured to the fluid cylinder at its end, from which the transverse header box is raised and lowered upon movement of the piston rod;

(c) a fluid driving power unit subassembly, mounted on the traveling support subassembly, comprising in turn a driving fluid motor and its attachment accessories to secure and to rotate a hollow core digging auger, and to secure and to rotate, alternatively, a capstan, to receive and to power a rope passing over the sheaves of the transverse header box, when one end of the rope is attached to a calibrated hammer used in preparing a core sample, and the other end of the rope is guided by an operator to, around, and from the capstan;

(d) a fluid control subassembly secured to the elongated guide member at an initially selected optional height to be conveniently manipulated by an operator, comprising in turn, a four way valve to alternatively direct the fluid to the fluid motor to rotate it in respective clockwise or counterclockwise directions, and to alternatively direct fluid to the fluid cylinder to extend or retract the piston and therefore correspondingly move the transverse header box, and also correspondingly move, via the tie rods, the traveling support subassembly on which the fluid power unit subassembly is mounted; and a fluid control valve serving alternatively as a throttle to control the speed of the fluid motor rotating a hollow core digging auger, and as a throttle to control the speed of the extension and retraction of the piston and consequently, also the transverse header box, and the fluid power unit subassembly, via the tie rods and the traveling support subassembly; and (e) a fluid power source and distribution subassembly, comprising, in turn, a fluid pump; a motor to drive the fluid pump; a fluid tank; a housing to secure together the fluid pump, motor, and tank in a conveniently handled power pack; and fluid hoses and fittings to conduct fluid to and from the often remotely located power pack, during distribution of the fluid via the fluid control subassembly to the fluid cylinder subassembly and to the fluid driving power unit subassembly, when earth core samples are being taken during soil testing operations.

2. The principal supporting structure for a portable machine used in drilling into the earth and taking earth core samples during soil testing operations, comprising:

(a) an upstanding body comprising in turn essentially a fluid cylinder subassembly, having a fluid cylinder, a piston rod extendable beyond the fluid cylinder to a distance almost equal to the length of the fluid cylinder, force transmitting tie rods secured to the extendable end of the piston rod and extending back in the direction of the fluid cylinder, an elongated guide member secured to the exterior of the fluid cylinder, and a sleeve secured to the transmitting tie rods and slidable up and down the fluid cylinder along the elongated guide member on the fluid cylinder, when the sleeve and the force transmitting tie rods move with the piston;

(b) a base for the upstanding body having radially extending legs.

3. The principal supporting structure for a portable machine used in drilling into the earth, as claimed in claim 2, wherein the base is conveniently removable from the upstanding body and has radially extending legs terminating in receiving portions, equipped with earth penetrating stakes drivable through the receiving portions.

4. The principal supporting structure for a portable machine used in drilling into the earth, as claimed in claim 2, comprising, in addition, a fluid driving power unit subassembly mounted on the sleeve which is slidable up and down the fluid cylinder, comprising, in turn, a driving fluid motor and its attachment accessories to secure and to rotate a hollow core digging auger.

5. The principal supporting structure for a portable machine used in drilling into the earth, as claimed in claim 4, having in addition a transverse header box having a sheave mounted at each of its ends and in turn mounted on the extendable end of the piston rod, and also having a capstan secured to the attachment accessories of the fluid motor to receive and to power a rope passing over the sheaves of the transverse header box, when one end of the rope is attached to a calibrated hammer used in preparing a core sample, and the other end of the rope is guided by an operator to, around, and from the capstan.

6. The principal supporting structure for a portable machine used in drilling into the earth, as claimed in claim 4, comprising in addition a fluid control subassembly secured to the elongated guide member on the fluid cylinder at a height for convenient manipulation by an operator, comprising in turn, a multiple valve subassembly to direct fluid to the fluid motor for operation in either rotational direction and to direct fluid to the fluid cylinder to extend or to retract the piston.

7. The principal supporting structure for a portable machine used in drilling into the earth, as claimed in claim 6, comprising in addition, in the fluid control assembly, a fluid liquid control valve serving as a throttle to control the speed of all the fluid actuated motions.

8. The principal supporting structure for a portable machine used in drilling into the earth, as claimed im claim 6, comprising in addition a combined fluid power source and distribution subassembly, comprising, in turn, a fluid pump; a motor to drive the fluid pump; a fluid tank; a housing to secure together the fluid pump, motor, and tank in a conveniently handled power pack, and fluid hoses and fittings to conduct fluid to and from the often remotely located power pack, during the distribution of the fluid, via the fluid control subassembly, to the fluid cylinder subassembly and to the fluid driving power unit subassembly, when earth core samples are being taken during soil testing operations.

9. The principal supporting structure for a portable machine used in drilling into the earth, as claimed in claim 8, comprising in addition, in the fluid control assembly, a fluid control valve serving as a throttle to control the speed of all the fluid actuated motions.

10. The principal supporting structure for a portable machine used in drilling into the earth, as claimed in claim 9, wherein the base is conveniently removable from the upstanding body and has radially extending legs terminating in receiving portions, equipped with earth penetrating stakes drivable through the receiving portions.

* * * * *